US005441837A

United States Patent [19]

Ong et al.

[11] Patent Number: 5,441,837

[45] Date of Patent: Aug. 15, 1995

[54] PHOTOCONDUCTIVE IMAGING MEMBERS WITH ACETOXYMETAL PHTHALOCYANINES

[75] Inventors: Beng S. Ong; Cheng-Kuo Hsiao, both of Mississauga, Canada

[73] Assignee: Xerox Corporation, Stamford, Conn.

[21] Appl. No.: 283,082

[22] Filed: Jul. 29, 1994

[51] Int. Cl.[6] ..... G03G 5/06

[52] U.S. Cl. ..... 430/58; 430/59; 430/78; 430/176

[58] Field of Search ..... 430/59, 78, 58, 126

[56] References Cited

U.S. PATENT DOCUMENTS

| | | | |
|---|---|---|---|
| 3,816,118 | 6/1974 | Byrne | 430/78 |
| 4,265,990 | 5/1981 | Stolka et al. | 430/59 |
| 4,424,266 | 1/1984 | Kurihara et al. | 430/59 |
| 4,471,039 | 9/1984 | Borsenberger et al. | 430/58 |
| 4,555,463 | 11/1985 | Hor et al. | 430/59 |
| 4,557,989 | 12/1985 | Branston et al. | 430/59 |
| 4,587,189 | 5/1986 | Hor et al. | 430/59 |
| 4,797,337 | 1/1989 | Law et al. | 430/58 |
| 5,189,156 | 2/1993 | Mayo et al. | 540/141 |
| 5,234,785 | 8/1993 | Itami et al. | 430/59 |

FOREIGN PATENT DOCUMENTS

| | | | |
|---|---|---|---|
| 3332005 | 3/1984 | Germany | 430/78 |
| 57-148745 | 9/1982 | Japan | 430/78 |

*Primary Examiner*—Christopher E. Rodee
*Attorney, Agent, or Firm*—E. O. Palazzo

[57] ABSTRACT

An imaging member comprised of an optional supporting substrate, a photogenerator layer, and a charge transport layer, and wherein the photogenerator layer is comprised of acetoxymetal phthalocyanine pigments as essentially represented by the formula

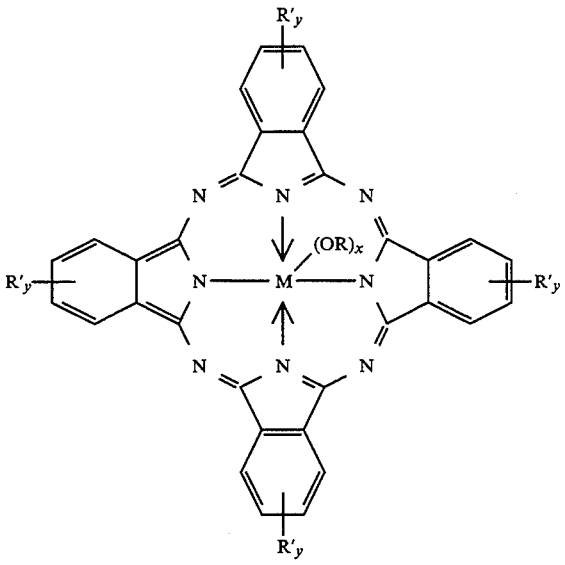

where R is acetyl, haloacetyl, or mixtures thereof; R' is alkyl, alkoxy, cyano, halogen, or mixtures thereof; M is a metal selected from the group consisting of aluminum, gallium, silicon, germanium and indium; x is 1 or 2; and y is 0, 1 or 2.

15 Claims, No Drawings

PHOTOCONDUCTIVE IMAGING MEMBERS WITH ACETOXYMETAL PHTHALOCYANINES

BACKGROUND OF THE INVENTION

The present invention is generally directed to photoconductive imaging members, and more specifically to photoconductive imaging members comprised of acetoxymetal phthalocyanine photogenerating pigments, such as trihaloacetoxymetal phthalocyanines like bis(trifluoroacetoxy)germanium phthalocyanine. In embodiments, the trihaloacetoxymetal phthalocyanine photogenerating pigments are obtained from the reactions of hydroxymetal phthalocyanines with a trihaloacetic acid in an inert solvent such as methylene chloride. One embodiment of the present invention is directed to an imaging member comprised of a supporting substrate, a photogenerating layer comprised of the acetoxymetal phthalocyanine pigments in contact therewith, and a charge, especially hole, transport layer. Imaging members with the photogenerating pigments of the present invention are especially sensitive to wavelengths of from about 700 to about 800 nanometers, that is in the near infrared wavelength region of the light spectrum, and these imaging members in many instances possess excellent electrical characteristics, such as low dark decay of less than 50 volts/second, and half exposure energy ($E_{\frac{1}{2}}$) of less than about 5 ergs/cm$^2$ when exposed to monochromatic radiation of about 700 to about 800 nanometers, thus enabling use thereof in imaging systems with high speeds, for example exceeding 50 pages per minutes, and with excellent cycling characteristics, thereby permitting the photoconductive imaging members with these pigments to be selected for use in electrophotographic imaging processes, and the like, in which infrared or near infrared radiations are utilized to discharge the surface potential of photoconductive imaging members.

Certain photoconductive imaging members are known, such as those comprised of a homogeneous layer of a single material such as vitreous selenium, or composite layered devices containing a dispersion of a photoconductive composition. An example of a composite xerographic photoconductive member is described in U.S. Pat. No. 3,121,006, which discloses finely divided particles of a photoconductive inorganic compound dispersed in an electrically insulating organic resin binder.

Photoconductive imaging members comprising inorganic or organic materials wherein the charge generating and charge transport functions are performed by discrete contiguous layers are also known. Additionally, layered photoconductive imaging members are disclosed in the prior art, including members with an overcoat layer of an electrically insulating polymeric material. Other layered photoconductive devices have been disclosed, including those comprising separate photogenerating layers and charge transport layers as described in U.S. Pat. No. 4,265,990, the disclosure of which is totally incorporated herein by reference. Photoresponsive materials containing a hole injecting layer overcoated with a hole transport layer, followed by an overcoating of a photogenerating layer, and a top coating of an insulating organic resin are disclosed in U.S. Pat. No. 4,251,612, the disclosure of which is totally incorporated herein by reference. Examples of photogenerating layers disclosed in these patents include trigonal selenium and phthalocyanines, while examples of transport layers include certain aryl diamines as illustrated therein.

Imaging members with certain phthalocyanines, such as metal phthalocyanines like titanyl phthalocyanine, vanadyl phthalocyanine, hydroxygallium phthalocyanine, or dihydroxygermanium phthalocyanine, are known. Some of the aforementioned imaging members possess photosensitivity in the near infrared region of the spectrum. However, many of these photogenerating pigments exhibit a variety of polymorphic forms with vastly different photosensitivities. These polymorphic forms are often sensitive to the process conditions under which the photoresponsive imaging members are fabricated. For example, the transformation of one polymorphic form to another may occur when the pigment is subjected to ball milling or simply being brought into contact with a certain solvent. This polymorphic transformation generally leads to changes in the pigment's photosensitivity and cyclic stability, and may result in the imaging member not meeting the performance requirements and specifications. The photogenerating pigments of the present invention are believed to be stable to a variety of fabrication conditions, and their photoconductivities are not affected by the fabrication processes. In addition, the acetoxymetal phthalocyanines can be readily prepared from the corresponding hydroxymetal phthalocyanines by simple processes, generally without lengthy post-reaction purification procedures.

U.S. Pat. No. 3,574,181 discloses bisazo compounds useful as coloring agents. Composite electrophotographic photosensitive materials containing various azo compounds are disclosed in U.S. Pat. No. 4,618,672, wherein bisazo compounds particularly suitable for use in the charge generating layer of a layered electrophotographic photoconductor are illustrated.

U.S. Pat. No. 4,7113,307, the disclosure of which is hereby totally incorporated by reference, also discloses photoconductive imaging members containing a supporting substrate, certain azo pigments as photogenerating materials, and a hole transport layer that preferably contains an aryl diamine compound dispersed in an inactive resinous binder.

U.S. Pat. No. 4,797,337, the disclosure of which is totally incorporated herein by reference, discloses a photoconductive imaging member comprising a supporting substrate., a hole transport layer, and a photogenerating layer comprising specific bisazo compounds.

Documents illustrating layered organic electrophotographic photoconductor elements with azo, bisazo, and related compounds include U.S. Pat. Nos. 4,390,611, 4,551,404, 4,596,754, 4,400,455, 4,390,608, 4,327,168, 4,299,896, 4,314,015, 4,486,522, 4,486,519, 4,555,667, 4,440,845, 4,486,800, 4,309,611, 4,418,133, 4,293,628, 4,427,753, 4,495,264, 4,359,513, 3,898,084, 4,830,944, and 4,820,602.

U.S. Pat. No. 4,424,266 discloses an electrophotographic photosensitive element having a conductive support and a photosensitive layer comprising a carrier generating phase layer containing a carrier generating material selected from the group consisting of perylene dyes, polycyclic quinones and azo dyes, and a carrier transporting phase layer containing a hydrazone carrier transporting material. The carrier generator materials can be used either singly or in combination.

In a copending application U.S. Ser. No. 105,264 preparative processes for dihydroxygermanium phthalocyanine photogenerating pigment, and its conversion to a Type II polymorphic form are disclosed. Another copending application U.S. Ser. No. 228,619 describes the preparation of Type III polymorph of dihydroxygermanium phthalocyanine and its use in infrared-responsive layered photoconductive imaging members. The disclosures of each of the aforementioned copending applications are totally incorporated herein by reference.

Although these known imaging members are suitable for their intended purposes, a need remains for improved imaging members that would satisfy a variety of performance requirements. For example, there is a particular need for imaging members containing photoconductive materials with improved photoconductivity. Another need resides in the provision of imaging members containing acetoxymetal phthalocyanine components, which are photoresponsive to near infrared radiations. There is also a need for imaging members with photoconductive materials comprised of certain acetoxymetal phthalocyanine photogenerating pigments, which pigments can be obtained in an electrically pure form by simple cost-effective processes. Further, there is a need for photoconductive materials with enhanced dispersibility in polymer solutions that enable low cost coating processes for the preparation of photoconductive imaging members. Additionally, there is a need for photoconductive materials that enable fabrication of imaging members with enhanced photosensitivity in the near infrared wavelength regions of the light spectrum enabling the resulting imaging members thereof to be selected for LED xerographic imaging processes and printers, and diode laser printer and imaging apparatuses.

SUMMARY OF THE INVENTION

Examples of objects of the present invention follow:

It is an object of the present invention to provide imaging members with many of the advantages illustrated herein.

It is another object of the present invention to provide imaging members with photoconductive materials with improved photoconductivity and dark decay characteristics.

It is a further object of the present invention to provide photoconductive imaging members with acetoxymetal phthalocyanine photogenerating pigments that enable members with enhanced photosensitivity in the infrared wavelength regions of the light spectrum, such as from about 700 to about 850 nanometers.

In one embodiment of the present invention there are provided exceptionally stable, for example no cycle-down after 50,000 imaging cycles, and low dark decay layered imaging members, certain acetoxymetal phthalocyanine photogenerating pigments.

Embodiments of the present invention are directed to layered imaging members comprised of a supporting substrate, a photogenerating layer comprised of photogenerating pigments comprised of the acetoxymetal phthalocyanine compounds represented, or essentially represented by the following formula

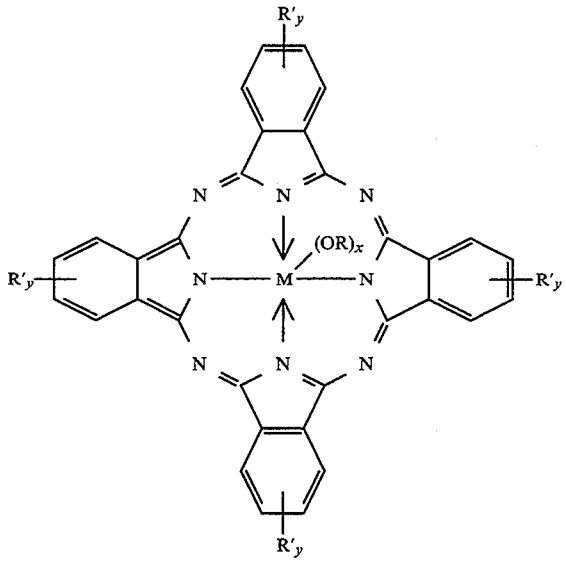

where R is acetyl, trihaloacetyl like trifluoroacetyl, trichloroacetyl, tribromoacetyl; R' is alkyl or alkoxy with 1 to about 25 and preferably with 1 to about 8 carbon atoms, cyano, halogen such as fluorine, chlorine, bromine, and iodine atom; M is a metal selected, for example, from the group consisting of aluminum, gallium, silicon, germanium and indium; x is 1 or 2, and y is 0, 1 or 2.

A specific embodiment of the present invention relates to layered photoresponsive imaging members comprised of a supporting substrate, a photogenerating layer containing bis(trihaloacetoxy)germanium phthalocyanine pigment represented, or essentially represented by the following formula

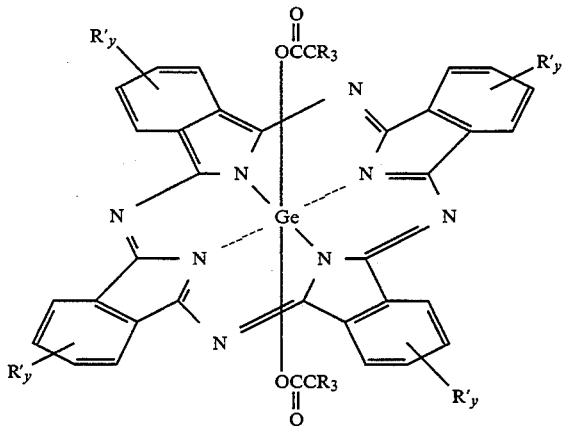

where R is fluorine, chlorine, or bromine; and R' is alkyl or alkoxy group with 1 to about 8 carbon atoms; cyano; halogen of fluorine, chlorine, bromine or iodine; and y is 0, 1 or 2.

Examples of acetoxymetal phthalocyanines include acetoxyaluminum phthalocyanine, trifluoroacetoxyaluminum phthalocyanine, trichloroacetoxyaluminum phthalocyanine, acetoxygallium phthalocyanine, trifluoroacetoxygallium phthalocyanine, diacetoxysilicon phthalocyanine, bis(trifluoroacetoxy)silicon phthalocyanine, bis(trichloroacetoxy)silicon phthalocyanine, diacetoxygermanium phthalocyanine, bis(trifluoroacetoxy)germanium phthalocyanine, bis(trichloroacetoxy)germanium phthalocyanine, acetoxyindium phthalocyanine, trifluoroacetoxyindium phthalocyanine, and trichloroacetoxyindium phthalocyanine, and the like.

In embodiments, the imaging members of the present invention are comprised of, in the order indicated, a conductive substrate, a photogenerating layer comprising acetoxymetal phthalocyanine photogenerating pigments, optionally dispersed in an inert resinous binder composition, and a charge transport layer, which comprises charge transporting molecules dispersed in an inactive resinous binder composition.

In another embodiment, the photoconductive imaging member comprises a conductive substrate, a hole transport layer comprising a hole transport molecule, such as an aryl amine, dispersed in an inactive resinous binder, and as a top layer a photogenerating layer comprising acetoxymetal phthalocyanine photogenerating pigments optionally dispersed in a resinous binder; or a conductive substrate, a hole blocking metal oxide layer, an optional adhesive layer, a photogenerating layer comprised of the acetoxymetal phthalocyanine photogenerating pigments of the present invention or mixtures thereof, optionally dispersed in a resinous binder composition, and an aryl amine hole transport layer comprising aryl amine hole transport molecules optionally dispersed in a resinous binder.

The substrate can be formulated entirely of an electrically conductive material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the system. In a particularly preferred embodiment, the thickness of this layer is from about 3 mils to about 10 mils. The substrate can be opaque or substantially transparent and can comprise numerous suitable materials having the desired mechanical properties. The entire substrate can comprise the same material as that in the electrically conductive surface, or the electrically conductive surface can merely be a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the electrophotoconductive member. Generally, the conductive layer ranges in thickness of from about 50 Angstroms to many centimeters, although the thickness can be outside of this range. When a flexible electrophotographic imaging member is desired, the thickness typically is from about 75 Angstroms to about 750 Angstroms. The substrate can be of any other conventional material, including organic and inorganic materials. Typical substrate materials include insulating nonconducting materials such as various polymer materials known for this purpose including polycarbonates, polyamides, polyurethanes, polyesters such as MYLAR ® (available from DuPont) or MELINEX 447 ® (available from ICI Americas, Inc.), paper, glass, and the like. If desired, a conductive substrate can be coated onto an insulating material. In addition, the substrate can comprise a metallized plastic, such as titanized or aluminized MYLAR ®, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

In embodiments, intermediate adhesive layers between the substrate and subsequently applied layers may be desirable to improve adhesion. If such adhesive layers are utilized, they preferably have a dry thickness of from about 0.01 micron to about 5 microns, although the thickness can be outside of this range. Typical adhesive layers include adhesion-promoting polymers, such as polyester, polyvinylbutyral, polyvinylpyrolidone, polycarbonate, polyurethane, polymethylmethacrylate, and the like, as well as mixtures thereof. Since the surface of the substrate can be a metal oxide layer or an adhesive layer, the expression "substrate" as employed herein is intended to include a metal oxide layer with or without an adhesive layer on a metal oxide layer.

The photogenerating layer is of an effective thickness, for example, of from about 0.05 micron to about 10 microns or more, and in embodiments has a thickness of from about 0.1 micron to about 3 microns. The thickness of this layer, however, is dependent primarily on the concentration of photogenerating material in the layer. This photogenerating layer is comprised of the photogenerating pigment dispersed in an optional binder material, with the concentration of photogenerating pigment being generally in the range of from about 5 to 100 percent by weight. Preferably, the photogenerating material is present in this layer in an effective concentration ranging from about 20 to about 90 percent by weight, and the binder material being in the range of from 10 to about 80 percent by weight. In general, it is also desirable to have this layer in a thickness sufficient to absorb at least 90 percent or more of the incident radiation which is directed upon it in the imagewise or printing exposure step. The maximum thickness of this layer is dependent primarily upon factors such as mechanical considerations, such as the specific photogenerating compound selected, the thicknesses of the other layers, and whether a flexible photoconductive imaging member is desired.

Charge transport layers are well known in the art. Typical transport layers are described, for example, in U.S. Pat. Nos. 4,265,990; 4,609,605; 4,297,424 and 4,921,773, the disclosures of each of these patents being totally incorporated herein by reference. Organic charge transport materials can also be employed. Typical charge, especially hole, transporting materials include the following.

Hole transport molecules of the type described in U.S. Pat. Nos. 4,306,008; 4,304,829; 4,233,384; 4,115,116; 4,299,897; 4,081,274 and 5,139,910, the disclosures of each of which are totally incorporated herein by reference, can be selected for the imaging members of the present invention. Typical diamine hole transport molecules include N,N'-diphenyl-N,N'-bis(3-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(3-chlorophenyl)-(1,1'-biphenyl)-4,4'-diamine, N,N'-diphenyl-N,N'-bis(4-chlorophenyl)-(1,1'-biphenyl)-4,4'-diamine, N,N,N',N'-tetraphenyl-[2,2'-dimethyl-1,1'-biphenyl]-4,4'-diamine, N,N,N',N'-tetrakis(4-methylphenyl) [2,2'-dimethyl-1,1'-biphenyl]-4,4'-diamine, N,N'-diphenyl-N,N'-bis(4-methylphenyl)-[2,2'-dimethyl-1, 1'-biphenyl]-4,4'-diamine, N,N'-diphenyl-N,N'-bis(2-methylphenyl)-[2,2'-dimethyl- 1,1'-biphenyl]-4,4'-diamine, N,N'-diphenyl-N,N'-bis(3-methylphenyl)-[2,2'-dimethyl- 1, 1'-biphenyl]-4,4'diamine, N,N'-diphenyl-N,N'-bis(3-methylphenyl)-pyrenyl-1,6-diamine, and the like.

Substituted fluorene charge transport molecules as described in U.S. Pat. No. 4,245,021, the disclosure of which is totally incorporated herein by reference, can also be selected. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene, and the like.

Other hole transport molecules such as N,N-bis(-biarylyl)anilines and tris(biarylyl)amines as disclosed in U.S. Pat. No. 4,869,988, diaryl biarylylamines as disclosed in U.S. Pat. No. 4,946,754, N,N-bis(biarylyl)aniline hole transport polymers as disclosed in U.S. Pat. Nos. 4,937,165; 4,959,288 and 5,011,906, the disclosures of which are totally incorporated by reference, can also be selected provided the functions and objectives of the imaging members are accomplished.

In embodiments of the present invention, a preferred hole transport layer is preferably comprised of components as represented, or essentially represented, by the following general formula

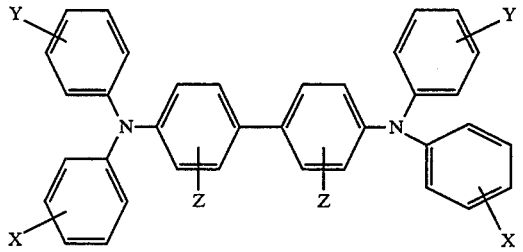

wherein X, Y and Z are selected from the group consisting of hydrogen atom, an alkyl group with, for example, from 1 to about 10 carbon atoms and a halogen atom, preferably chlorine, and at least one of X, Y and Z is independently an alkyl group or chlorine. When Y and Z are hydrogen atoms, the compound may be named N,N'-diphenyl-N,N'-bis(alkylphenyl)(1,1'-biphenyl)-4,4'-diamine wherein the alkyl is, for example, methyl, ethyl, propyl, n-butyl, pentyl, or the like, or the compound may be N,N'-diphenyl-N,N'-bis(chlorophenyl)-(1,1'-biphenyl)-4,4'-diamine.

The charge transport layer is generally comprised of a matrix of charge transport molecule:; dispersed in an insulating inactive resinous binder. The binder material is preferably and importantly substantially completely transparent or substantially transparent to the incident radiations utilized for photodischarging the photoreceptor. The charge transport material is present in the charge transport layer in an effective amount, generally from about 5 to about 100 percent by weight, preferably from about 25 to about 75 percent by weight, and more preferably from about 30 to about 60 percent by weight.

Examples of the transparent inactive resinous binder material which may be utilized as the binder for the transport layer include materials such as those described in U.S. Pat. No. 3,121,006, the disclosure of which is totally incorporated herein by reference. Specific examples of suitable organic resinous materials include polycarbonates, acrylate polymers, vinyl polymers, cellulose polymers, polyesters, polysiloxanes, polyamides, polyurethanes, polystyrenes, and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. Generally, the resinous binder contains from about 5 to about 90 percent by weight of the active material corresponding to the foregoing formula, and preferably from about 2.0 percent to about 75 percent of this material.

Similar binder materials may be selected for the photogenerating layer, including polyesters, polyvinyl butyrals, polyvinylcarbazole, polycarbonates, polyvinyl formals, poly(vinylacetals) and those illustrated in U.S. Pat. No. 3,121,006, the disclosure of which is totally incorporated herein by reference.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging. This layer is of a thickness of less than 50 Angstroms to about 10 microns, preferably being no more than about 2 microns.

In addition, the photoconductive imaging member may optionally contain an adhesive interface layer situated between the hole blocking layer and the photogenerating layer. This layer may comprise a polymeric material such as polyester, polyvinyl butyral, polyvinyl pyrrolidone and the like. Typically, this layer is of a thickness of less than about 0.6 micron.

The photogenerating compounds of the present invention in embodiments thereof enable enhanced photosensitivity in the infrared wavelength range. In particular, imaging members with photosensitivity at wavelengths of up to about 870 nanometers, are provided in embodiments of the present invention, which renders them particularly useful for imaging and printing applications, such as LED and diode laser printing processes, which typically require sensitivity of about 600 to about 800 nanometers.

The present invention also encompasses a method of generating images with the photoconductive imaging members disclosed herein. The method comprises the steps of generating an electrostatic latent image on a photoconductive imaging member of the present invention, developing the latent image, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate may be by any method, including those making use of a corotron or a biased roll. The fixing step may be performed by means of any suitable method, such as flash fusing, heat fusing, pressure fusing, vapor fusing, and the like. Any material used in xerographic copiers and printers may be used as a substrate, such as paper, transparency material, or the like.

Specific embodiments of the invention will now be described in detail. These Examples are intended to be illustrative, and the invention is not limited to the materials, conditions, or process parameters set forth in these embodiments. Parts and percentages are by weight unless otherwise indicated.

EXAMPLE I

The following example illustrates the preparation bis(trifluoroacetoxy)germanium phthalocyanine from dichlorogermanium and diiminoisoindolene precursors.

A suspension of 280.0 grams of diiminoisoindolene in 1.5 liters of 1-chloronaphthalene was mechanically stirred in a 3 liter flask fitted with a thermometer, a mechanical stirrer and a water condenser under a nitrogen atmosphere. 100 Grams of germanium tetrachloride were slowly added to the suspension, and the resulting mixture was heated to reflux, and then maintained at this temperature for 2.5 hours. Subsequently, the reaction mixture was cooled to about 100° C., and filtered through a sintered glass funnel. The resulting crude product was washed with five 100 milliliter portions of boiling dimethylformamide, then with 500 milliliters of methanol, followed by drying in vacuo at 75° C. overnight, about 20 hours, yielding 61.4 grams of blue crystals of dichlorogermanium phthalocyanine product.

25.0 Grams of dichlorogermanium phthalocyanine as prepared in accordance with the above procedure were added in small portions to 350 milliliters of concentrated sulfuric acid with continuous stirring over a period of 20 to 30 minutes. The resulting black solution was stirred at room temperature, about 25° C., for 4 hours, and was then poured slowly onto 2.0 kilograms of crushed ice over a period of about 1 hour. The precipitated blue dihydroxygermanium phthalocyanine product was filtered, washed twice with dilute aqueous ammonium hydroxide solution, and several times with water, and dried. There resulted 24.2 grams of Type I dihydroxygermanium phthalocyanine. The latter was stirred in a mixture of 50 milliliters of trifluoroacetic acid and 200 milliliters of methylene chloride for 30 minutes at room temperature. The mixture was then filtered and washed several times with :methylene chloride, and dried in vacuo at 75° C. to afford 24.7 grams of bis(trifluoroacetoxy)germanium phthalocyanine.

Infrared Spectrum: 1,730 $cm^{-1}$

Elemental Analysis, calculated for $C_{36}H_{16}N_8O_4F_6Ge$: C, 53.31; H, 1.99; N, 13.81; F, 14.05

Found: C, 51.89; H, 1.90; N, 13.40; F, 14.40

EXAMPLE II

Bis(trifluoroacetoxy)germanium phthalocyanine was also readily prepared from Type II dihydroxygermanium phthalocyanine as described in the following illustrative procedure.

2.05 Grams of Type II dihydroxygermanium phthalocyanine was added to 20 milliliters of 1:4 mixture by volume of trifluoroacetic acid and methylene chloride at room temperature. The resulting blue suspension was stirred at room temperature for 30 minutes to an hour and then filtered. The solid product was subsequently washed several times with methylene chloride and dried in vacuo. The yield of bis(trifluoroacetoxy)germanium phthalocyanine product was about 96 percent.

EXAMPLE III

Bis(trifluoroacetoxy)germanium phthalocyanine was also prepared from Type III dihydroxygermanium phthalocyanine in accordance with the procedure of Example II in 94 percent yield.

EXAMPLE IV

A photoconductive imaging member was fabricated by coating an aluminized MYLAR® substrate (3 mils) with a solution comprised of 6.5 grams of acetylacetonate tributoxyzirconium and 0.75 gram of (3-aminopropyl)trimethoxysilane in 28.5 grams of isopropanol and 14.3 grams of butanol using a wire wound rod applicator. The coated layer was dried at 140° C. for 10 minutes, giving a dry thickness of 0.1 micron. A photogenerator pigment dispersion was prepared by milling a mixture of 0.56 gram of bis(trifluoroacetoxy)germanium phthalocyanine of Example I and 20.0 grams of 1.3 percent poly(vinyl butyral) in butyl acetate in a 60 milliliter jar containing 70 grams of glass beads (1 millimeter diameter) by means of a paint shaker for 2 hours. The dispersion was then coated onto the zirconium layer as prepared above using the wire wound rod applicator, and dried at 100° C. for 10 minutes, thereby forming a photogenerator layer of a thickness of 0.17 micron. The hole transport layer was prepared by coating a solution of 5.4 grams of N,N'-diphenyl-N,N'-bis(3-methylphenyl)-1,1'-biphenyl-4,4'-diamine and 8.1 grams of polycarbonate in 58.0 grams of chlorobenzene onto the photogenerator layer, and dried at 110° C. for 1 hour; the thickness of this layer was 27.9 microns.

The imaging member thus prepared was evaluated as follows. Xerographic measurements were made on a flat plate scanner using 2 inch by 2.5 inch samples of the imaging member prepared as described herein. The surface of the test sample was electrostatically charged with a corona discharge source, and the surface potential was monitored with a capacitively coupled ring probe connected to a Keithley electrometer (Model 610C) in the coulomb mode. The output of the electrometer was displayed on a plotter recorder (HP Model 7470A) which was calibrated by applying known voltage on an uncoated aluminum substrate. The exposure wavelength and the intensity were selected and adjusted using interference and neutral density filters, respectively. With the shutter closed, the dark decay was measured. With the shutter open, the photosensitivity at a known light exposure was recorded. The imaging member was charged to an initial value $V_o$ of about −800 to −1,000 volts at the peak voltage and was allowed to discharge in the dark for 0.5 second to a dark development potential $V_{ddp}$. The dark decay in volts/second was calculated as $(V_o - V_{ddp})/0.5$. Subsequently, an erase lamp was used to photodischarge the surface charge and to determine its residual voltage ($V_R$). Thereafter, the imaging member was charged in a similar manner and exposed to monochromatic radiation at the dark development potential, thereby effecting a photoinduced discharge of the surface potential from $V_{ddp}$ to a background potential $V_{bg}$. The sensitivity of the member was determined in terms of half-exposure energy, $E_{\frac{1}{2}}$, which represents the energy required to discharge the surface potential to half of $V_{ddp}$. For this imaging member, $V_{ddp}$ was −840 volts, the dark decay was −28 volts/second and $E_{\frac{1}{2}}$ was 2.1 ergs/cm$^2$ when exposed to 740 nanometers radiation and 4.1 ergs/cm$^2$ to 780 nanometers radiation.

EXAMPLE V

A photoconductive imaging member employing bis(trifluoroacetoxy)germanium phthalocyanine as obtained in Example II was fabricated in accordance with the procedure of Example IV. For this imaging member, $V_{ddp}$ was −822 volts, the dark decay was −41 volts/second and $E_{\frac{1}{2}}$ was 2.2 ergs/cm$^2$ when exposed to 740 nanometers radiation and 4.5 ergs/cm$^2$ to 780 nanometers radiation.

EXAMPLE VI

There was prepared a layered photoconductive imaging member containing the photogenerating pigment of Example III according to the following procedure.

The photogenerating pigment dispersion was prepared by first dissolving in a 1 ounce brown bottle 0.053 milligram of polyvinyl formal (obtained from Scientific Polymer Products, Inc., formal content 82 percent, acetate content 12 percent, hydroxy content 6 percent) and 10 milliliters of tetrahydrofuran. To the bottle was then added 0.21 gram of the above bis(trifluoroacetoxy)germanium phthalocyanine pigment and about 90 grams of steel shot ($\frac{1}{8}$ inch diameter, number 302 stainless steel shot). The bottle was then placed on a Red Devil Paint Conditioner (Model 5100X) and shaken for about 30 minutes. The resulting dispersion was coated onto a 7.5 inch by 10 inch brush-grained aluminum substrate obtained from Ron Ink Company using a Gardner Mechanical Drive with a 6 inch wide Bird Film Applicator (0.5 mil wet gap) inside a humidity controlled glove box. The relative humidity of the glove box was controlled by dry air to about 25 percent, or less. The resulting photogenerator layer was air dried for about 30 minutes and then vacuum dried for about 1 hour at 100° C. before further coating. The thickness of the charge generator layer was about 0.4 micron as estimated from TEM micrographs.

The above charge generator layer was overcoated with a hole transport layer comprised of 60 weight percent of the polycarbonate and 40 weight percent of aryl diamine hole transport molecules prepared as follows. A solution containing 4.2 grams of polycarbonate, 2.8 grams of N,N'-bis(3''-methylphenyl)-1,1'-biphenyl-4,4'-diamine prepared as disclosed in U.S. Pat. No. 4,265,990, the disclosure of which is totally incorporated herein by reference, was prepared by dissolving the above materials in 31 milliliters of methylene chloride inside a 2 ounce amber bottle. The transport layer was obtained by coating the solution onto the charge generator layer using a 3.5 inch wide, 5 mil wet gap Bird Film applicator, resulting in a transport layer about 27 microns thick. The resulting photoconductive device was air dried for about 1 hour and vacuum dried at 100° C. for about 16 hours before evaluation on a flat plate imaging test fixture.

The imaging member as prepared above was evaluated in accordance with the procedure of Example V. For this imaging member, $V_{ddp}$ was −804 volts, the dark decay was −45 volts/second and $E_{\frac{1}{2}}$ was 2.5 ergs/cm$^2$ when exposed to 740 nanometers radiation and 5.0 ergs/cm$^2$, when exposed to 780 nanometers radiation.

EXAMPLE VII

There was prepared a photoconductive imaging member containing bis(trifluoroacetoxy)germanium phthalocyanine pigment as prepared in Example IV with the exception that a titanized MYLAR ® substrate was used in place of the aluminum substrate. The imaging member exhibited a $V_{ddp}$ of −840 volts, a dark decay of −30 volts/second, an $E_{\frac{1}{2}}$ of 2.1 erg/cm$^2$ when exposed to 740 nanometers radiation, and of 4.2 erg/cm$^2$ when exposed to 780 nanometers radiation.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging member consisting of a supporting substrate, a bis(trifluoroacetoxy)germanium phthalocyanine-containing photogenerator layer, and a charge transport layer.

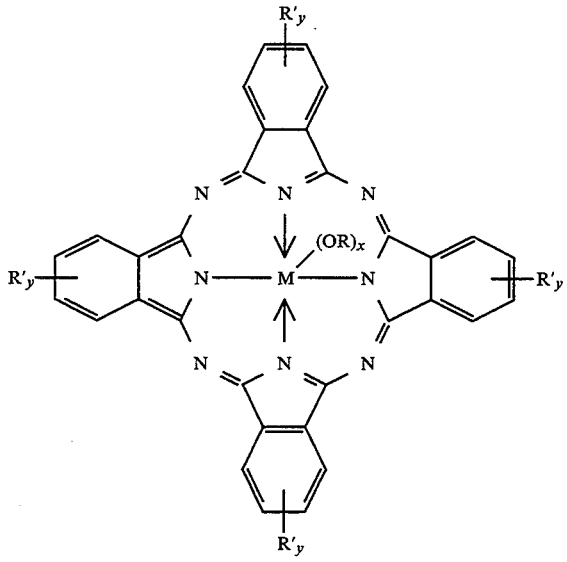

2. An imaging member in accordance with claim 1 wherein the photogenerator layer is situated between the substrate and the charge transport layer.

3. An imaging member in accordance with claim 1 wherein the charge transport layer is situated between the substrate and the photogenerator layer.

4. An imaging member in accordance with claim 1 wherein the photogenerator layer has a thickness of from about 0.05 to about 10 microns.

5. An imaging member in accordance with claim 1 wherein said bis(trifluoroacetoxy)germanium phthalocyanine is dispersed in a resinous binder in an amount of from about 5 percent by weight to about 95 percent by weight.

6. An imaging member in accordance with claim 5 wherein the resinous binder is selected from the group consisting of polyesters, polyvinyl butyrals, polycarbonates, and polyvinyl formals.

7. An imaging member in accordance with claim 1 wherein the charge transport layer comprises aryl amine molecules.

8. An imaging member in accordance with claim 18 wherein the aryl amine is of the formula

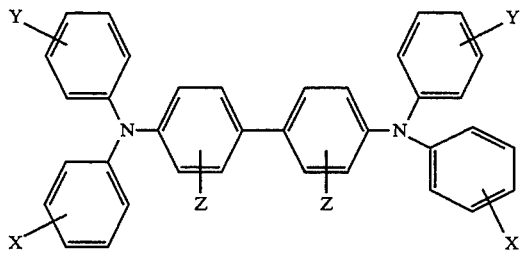

wherein X, Y, and Z are hydrogen, alkyl group or halogen atom, and wherein the aryl amine is dispersed in a highly insulating and transparent resinous binder.

9. An imaging member in accordance with claim 8 wherein alkyl contains from about 1 to about 10 carbon atoms.

10. An imaging member in accordance with claim 8 wherein alkyl contains from 1 to about 5 carbon atoms.

11. An imaging member in accordance with claim 8 wherein alkyl is methyl.

12. An imaging member in accordance with claim 8 wherein halogen is chlorine.

13. An imaging member in accordance with claim 8 wherein the resinous binder is selected from the group consisting of polycarbonates and polystyrenes.

14. An imaging member in accordance with claim 1 wherein said germanium phthalocyanine is dispersed in poly(vinyl butyral) and the transport layer is comprised of N,N'-diphenyl-N,N'-bis(3-methylphenyl)-1,1'-biphenyl-4,4'diamine molecules.

15. A method of imaging which comprises generating an electrostatic latent image on an imaging member consisting of a supporting substrate, a bis(trifluoroacetoxy)germanium phthalocyanine-containing photogenerator layer, and a charge transport layer, developing the latent image, and transferring the developed electrostatic image to a suitable substrate.

* * * * *